US005758721A

United States Patent [19]

Letrange et al.

[11] Patent Number: 5,758,721

[45] Date of Patent: Jun. 2, 1998

[54] HEAT EXCHANGER HEADER PLATE, A METHOD FOR MAKING IT, AND A HEAT EXCHANGER HAVING SUCH A HEADER PLATE

[75] Inventors: Frederic Letrange, Nanterre; Carlos Martins, Montfort L'Amaury, both of France

[73] Assignee: Valeo Thermique Moteur, Le Mesnil-Saint-Denis, France

[21] Appl. No.: 762,863

[22] Filed: Dec. 10, 1996

[30] Foreign Application Priority Data

Dec. 13, 1995 [FR] France ..... 95 14784

[51] Int. Cl.[6] ..... F28F 9/02

[52] U.S. Cl. ..... 165/173; 165/149; 165/175

[58] Field of Search ..... 165/149, 151, 165/153, 173, 175

[56] References Cited

U.S. PATENT DOCUMENTS

| | | | |
|---|---|---|---|
| 2,073,778 | 3/1937 | Boerger | 165/151 X |
| 2,539,701 | 1/1951 | Przyboroski | 165/173 X |
| 3,113,615 | 12/1963 | Huggins | 165/149 |
| 4,461,348 | 7/1984 | Toge et al. | 165/173 |
| 4,582,127 | 4/1986 | Moranne | 165/173 X |
| 5,195,581 | 3/1993 | Puntambekar et al. | 165/173 |
| 5,586,600 | 12/1996 | Cribari | 165/173 |

FOREIGN PATENT DOCUMENTS

| | | | |
|---|---|---|---|
| 2 349 813 | 11/1977 | France . | |
| 60485 | 3/1993 | Japan | 165/175 |

*Primary Examiner*—Leonard R. Leo
*Attorney, Agent, or Firm*—Morgan & Finnegan, L.L.P.

[57] ABSTRACT

A heat exchanger has a header plate which comprises a substantially flat base wall, which defines over at least part of its periphery a recess for receiving a claw element of a header cover. This recess is bounded on one side by projections formed on an inner face of the base wall, and on another side by a bent-back edge portion, from which retaining lugs extend. These retaining lugs are bent back to secure the header cover in position. The invention is applicable to heat exchangers for motor vehicles.

8 Claims, 3 Drawing Sheets

HEAT EXCHANGER HEADER PLATE, A METHOD FOR MAKING IT, AND A HEAT EXCHANGER HAVING SUCH A HEADER PLATE

FIELD OF THE INVENTION

This invention relates to header plates for heat exchangers, in particular for motor vehicles. It also relates to a method for making such a header plate, and to a heat exchanger incorporating such a header plate.

More particularly, the invention relates to a header plate of the type comprising a base wall which defines, over at least part of its periphery, a recess for receiving a claw element of a header cover, the base wall being provided with retaining lugs which are capable of being bent back so as to engage the header cover, whereby to secure the header cover and header plate together.

BACKGROUND OF THE INVENTION

In known header plates of the above general type, the recess which is adapted to receive the claw element of the header cover is usually made in the form of a U-shaped peripheral groove which is obtained by deformation of the base wall of the header plate. This peripheral groove is arranged to receive the claw element, usually in the form of a peripheral bead, of the header cover, with a sealing gasket being interposed. The header cover and header plate are then secured together by a seaming operation in which the retaining lugs of the header plate are bent back into engagement with the claw element.

One of the disadvantages of this known arrangement is that it is necessary to provide specific header plates, and therefore specific tooling, for each type of header plate. In addition, since the peripheral groove usually extends over the whole perimeter of the header plate, that is to say along not only its longitudinal sides but also its transverse sides, the presence of the groove in the region of its transverse sides increases the overall size of the header plate along its major dimension. As a result, the operations of assembling the header plate and the header cover together are increased in complexity.

DISCUSSION OF THE INVENTION

A main object of the invention is to overcome the above mentioned drawbacks.

According to the invention in a first aspect, a header plate for a heat exchanger, of the type comprising a base wall which defines, over at least part of its periphery, a recess for receiving a claw element of a header cover, the base wall being provided with retaining lugs which can be bent back so as to retain the said claw element, is characterised in that the base wall is substantially flat, and in that the recess for receiving the claw element is delimited on one side by projections formed on an inner face of the base wall, and, on another side, by a bent back edge portion of the base wall, from which the retaining lugs extend.

As a result, the base wall is essentially flat, and it is no longer necessary to provide a peripheral groove for receiving the claw element of the header cover, as was the case with the header plates of the prior art.

The projections which are formed on the inner surface of the header plate serve as abutments for the claw element of the header cover, which is also held in position by the bent-back edge portion of the base wall of the header plate.

The said projections are preferably spaced apart and aligned with each other.

Preferably, the said projections comprise raised portions having a depth which is smaller than the thickness of the base wall, so as not to create any openings which could lead to leakage of fluid flowing in the space defined between the header plate and the header cover.

According to a preferred feature of the invention, the bent-back edge portion is extended by a reinforcing element which is turned back and bent under the bent-back edge portion on an outer face of the base wall, and the retaining lugs are made in the form of teeth by forming U-shaped slots through the thickness of the base wall. This reinforcing element enables the header plate to be reinforced in the region of its joint with the header cover, without making it necessary to provide any additional reinforcing members.

According to a preferred feature of the invention, the base wall has a substantially rectangular form and defines two parallel longitudinal recesses, each of which is delimited by a row of the said projections and by the longitudinal bent-back edge portion formed with the retaining lugs.

Preferably, the header plate has two transverse edges from which said projections are absent, the said transverse edges being adapted to be covered on the outside by a flange portion of the said claw element. As a result, it is the header cover that abuts on the header plate on the outside, along the transverse edges of the latter. This provides centring for the header cover prior to and during the seaming operation, that is to say until the retaining lugs are upset on to the claw element of the cover. The header plate is thus able to be made in the form of a profiled member which facilitates standardisation, because the latter can be of a common form regardless of the length of the header plate.

In addition, due to the fact that it is no longer necessary to provide a specific housing for the claw element of the header cover in the region of the transverse edges of the header, the length of the header plate, and therefore that of the heat exchanger as a whole, is reduced in size. This enables a larger number of heat exchange tubes to be provided for a given size of heat exchanger. It also enables the header plate to be more easily assembled to the tube bundle.

In general terms, the invention makes it possible to omit the preliminary seaming operation which is often necessary in the techniques of the prior art, since the header plate is now able to be simply fitted over the ends of the header plate.

According to another preferred feature of the invention, the header plate is formed from a metallic material having a braze alloy on its outer face opposite to its inner face.

According to the invention in a second aspect, a method of making a header plate according to the invention in its first aspect is characterised in that it includes the following operations:

(a) providing a generally flat metallic strip having an inner face and an outer face, (b) forming at least one set of projections which project from the inner face, (c) forming at least one set of retaining lugs by stamping within the thickness of the metal strip, and (d) forming at least one bent-back edge portion from which the retaining lugs extend.

Operations (b) and (c) are preferably carried out simultaneously in a press.

According to a further preferred feature of the invention, in operation (c), the retaining lugs are made in the form of teeth within U-shaped slots, so as to form a reinforcing element which extends beyond the retaining lugs.

Preferably, the method includes an additional operation (e), which consists in upsetting and bending back the reinforcing element under the bent-back edge portion, on the same side as the outer face of the metal strip. Operations (d) and (e) are preferably carried out using a profiled press tool.

According to yet another preferred feature of the invention, operation (b) forms two sets of projections which extend parallel to two longitudinal sides of the strip, and operation (c) forms two sets of retaining lugs along the two longitudinal sides. This enables a profiled component to be made which can be cut to the required length.

The method of the invention preferably includes a further operation (f) which consists in forming, in the base wall, holes and collar portions bounding the said holes, for the subsequent connection of the header plate to tubes of a heat exchanger body.

According to the invention in a third aspect, a heat exchanger includes at least one header plate according to the invention in its first aspect, or made by the method of the second aspect of the invention.

Various features and advantages of the invention will appear more clearly on a reading of the following detailed description of preferred embodiments of the invention, which are given by way of non-limiting example only and with reference to the accompanying drawings.

DESCRIPTION OF PREFERRED EMBODIMENTS OF THE INVENTION

Figure 1:
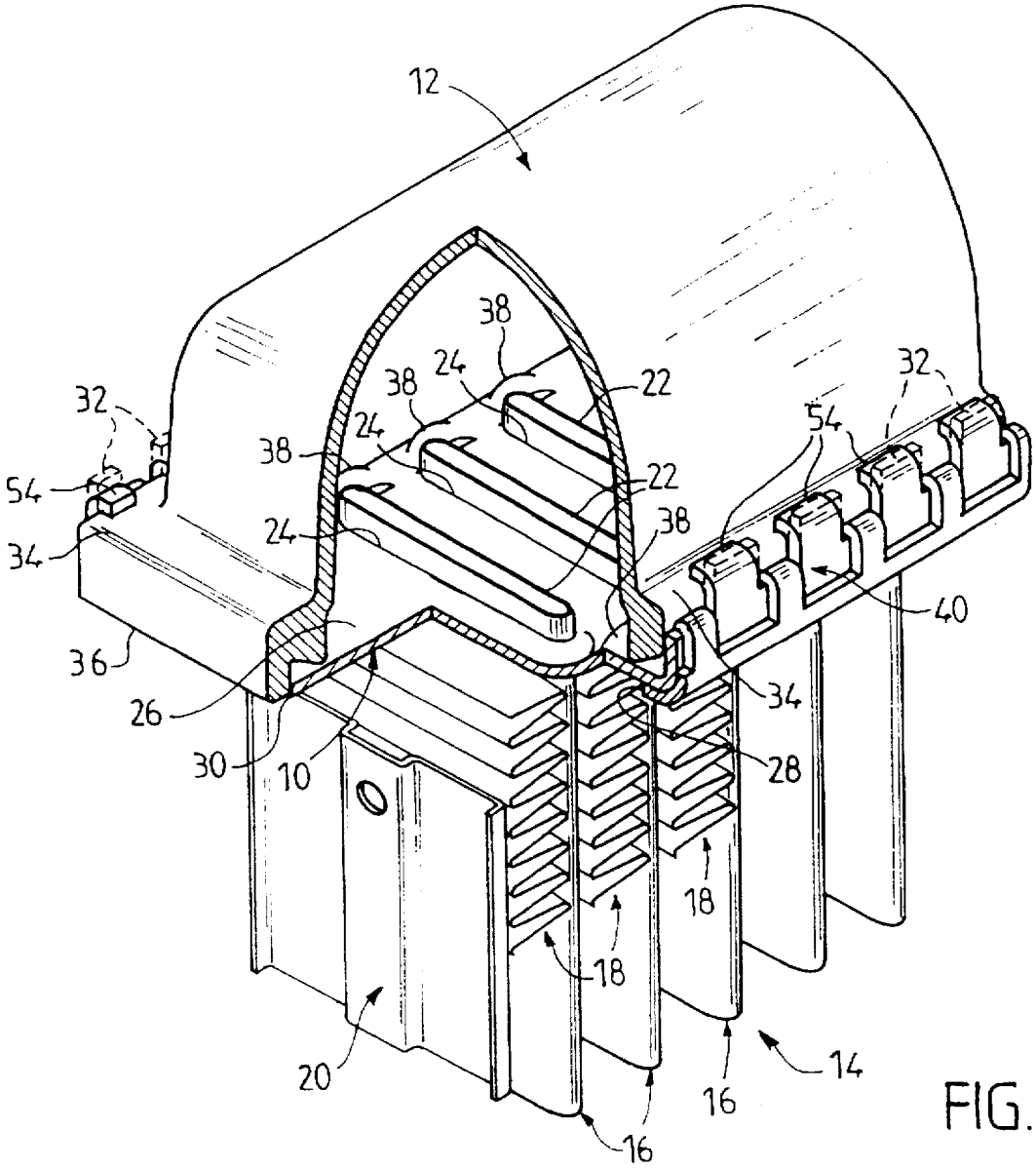
FIG. 1 is a perspective view, shown partly cut away, of part of a heat exchanger having a header plate in accordance with the invention.

The heat exchanger shown in FIG. 1 comprises a metal header plate 10 which is secured to a header cover (or water box) 12 of plastics material, so as to define between them a chamber through which a heat transfer fluid flows. The header plate 10 is also joined to a heat exchanger body which comprises a large number of flat tubes 1 6, between which corrugated inserts, constituting fins, are disposed. The heat exchanger body is flanked by two end plates 20, only one of which can be seen in FIG. 1. Each tube 16 has an end portion 22 which extends through a corresponding one of a plurality of holes 24 formed through the header plate 10.

The header plate 10 is made of a metallic material, for example aluminium. It has a base wall 26 which is substantially flat and rectangular, and in which the above mentioned holes 24 are formed. The header plate 10 is made from a metal strip by a method illustrated by FIGS. 2 to 6. This metal strip is initially flat, and has two parallel longitudinal sides 28. At the sides, the strip is bounded by two transverse sides 30, only one of which can be seen in FIGS. 1 to 4.

Two sets of retaining lugs 32, for securing the header cover 12 to the header plate 10, are arranged along the longitudinal sides 28.

The header cover 12 is bounded by a claw element 34, having a generally rectangular profile and comprising two longitudinal portions and two transverse portions. The two longitudinal portions of the claw element 34 are held in engagement against the base wall 26 of the header plate by the two sets of lugs 32 respectively, after the latter have been bent back towards the claw element 34. However, the two transverse portions of the claw element 34 are not held in place by any lugs. In this connection, each of the transverse portions of the claw element includes a flange portion 36 (FIG. 1), which abuts on the header plate 10 on the outside, and at the same time provides centring for the header plate in the header cover. A sealing gasket (not shown in FIG. 1) is interposed between the claw element 34 and the header plate 10.

As can also be seen in FIG. 1, the base wall 26 is formed with two rows of projections 38. Each of these rows of projections is disposed close to a respective one of the two longitudinal sides 28 of the header plate. The purpose of the projections 38 is to hold the two longitudinal portions of the claw element 34 so as to prevent them from pivoting inwards. In this example, the projections 38 are in the form of portions raised by stamping, and their depth is smaller than the thickness of the base wall 26.

Figure 5:
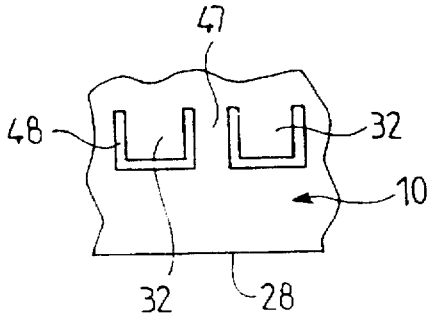
FIG. 5 shows the formation of tooth-shaped retaining lugs.
Figure 2:
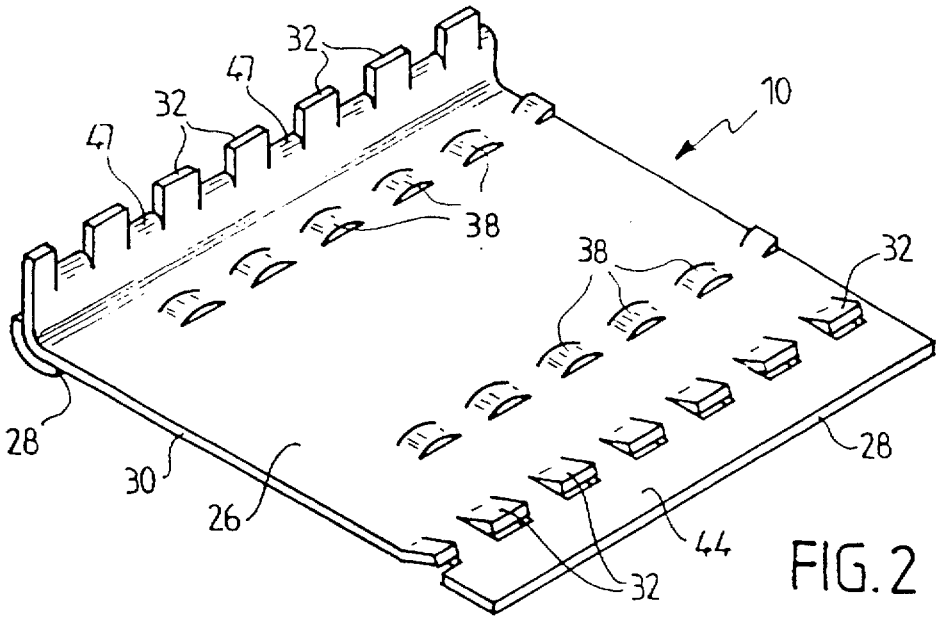
FIG. 2 is a perspective view of part of a header plate in the course of manufacture.
Figure 6:
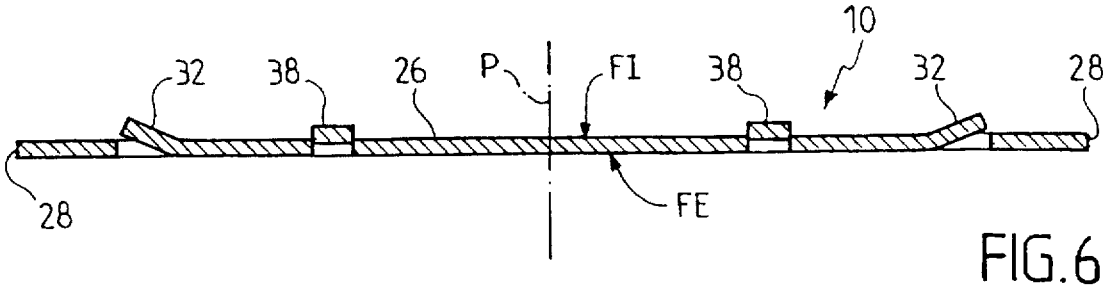
FIG. 6 is a view in transverse cross section of the header plate after a first step in the manufacturing operation.

The manufacture of the header plate 10 will now be described, with reference in particular to FIGS. 2 to 8. The manufacturing process starts with a flat metallic strip which is bounded by the two longitudinal sides 28 (FIGS. 2 and 6). This strip, which is made for example of aluminium, has an inner surface Fl and an outer surface FE (FIG. 6). The outer face FE is plated so as to be suitable for brazing.

In a first operation, using a suitable press, not shown, the two rows of projections 38 are formed so as to have, as mentioned above, the form of raised portions having a depth which is smaller than the thickness of the metallic strip. The two sets of retaining lugs 32, shown in FIGS. 2 and 6, are formed at the same time. It should be noted that the two sets of projections 38, and also the two sets of lugs 32, are symmetrical with respect to a median plane P of the metal strip (FIG. 6).

Figure 7:
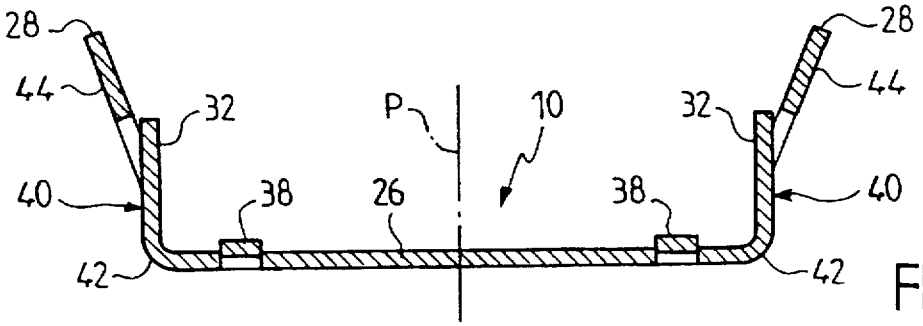
FIG. 7 is a view in cross section similar to that in FIG. 6, after a second step in the manufacturing operation.
Figure 8:
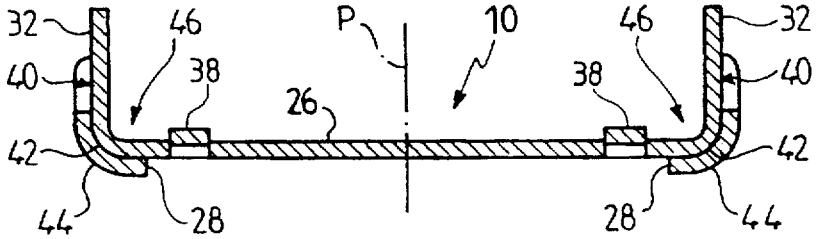
FIG. 8 is a view similar to that in FIG. 7 after a subsequent step.

In a subsequent operation, a profiled tool is used so as to bend the metal strip and to form two longitudinal bent-back edge portions 40, which are aligned at right angles to the body portion, or base wall, 26 of the metal strip, as can best be seen in FIG. 7. The two bent-back edge portions 40 are symmetrical about the plane P, and are joined to the base wall 26 through two rounded portions 42. As a result, the retaining lugs 32 project at right angles to the base wall 26. In addition, each aligned or bent edge portion 40 is extended beyond the retaining lugs 32 by a reinforcing element 44. As can be seen in FIG. 7, these two reinforcing elements 44 are arranged in an outwardly divergent orientation.

Figure 3:
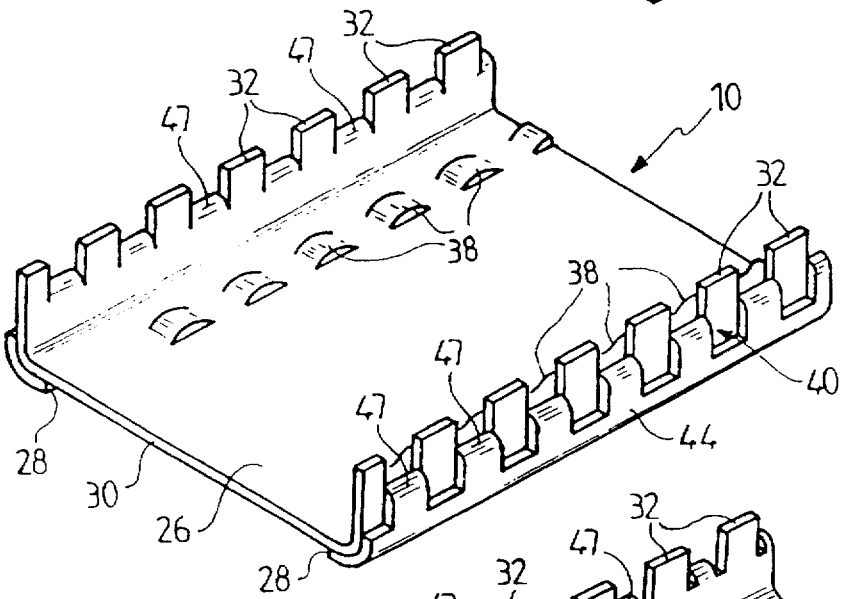
FIG. 3 is a view similar to that in FIG. 2, and shows a subsequent step in the manufacturing operation.

During the next step in the operation, the reinforcing elements 44 are bent over in such a way as to deform them into position under the bent longitudinal edge portions 40, on the same side of the work piece as its outer surface FE. This operation is carried out using a suitable profiled tool, and gives the structure which is shown in both FIG. 8 and FIG. 3. In this configuration, the retaining lugs 32 are still aligned at right angles to the base wall 26 of the workpiece, while the reinforcing elements 44 give a double thickness to the latter in each region of the metal strip on either side of the rounded portions 42. It will be noted that FIG. 3 shows in perspective the same structure as is shown in cross section in FIG. 8, while FIG. 2 shows a preceding operation.

In the configuration obtained in this way, the header plate defines two longitudinal recesses 46 which are symmetrical about the plane P. Each of these recesses 46 is defined between one row of the projections 38 and the corresponding edge portion 40, the latter being extended by the appropriate set of retaining lugs 32, FIG. 8. In the version shown in FIG. 3, the retaining lugs 32 are in the form of generally rectangular teeth formed by open stamping, in such a way that the reinforcing element 44 consists of a multiplicity of integral bridges 47, the width of which corresponds to the width of the space between two consecutive retaining lugs 32.

Figure 4:
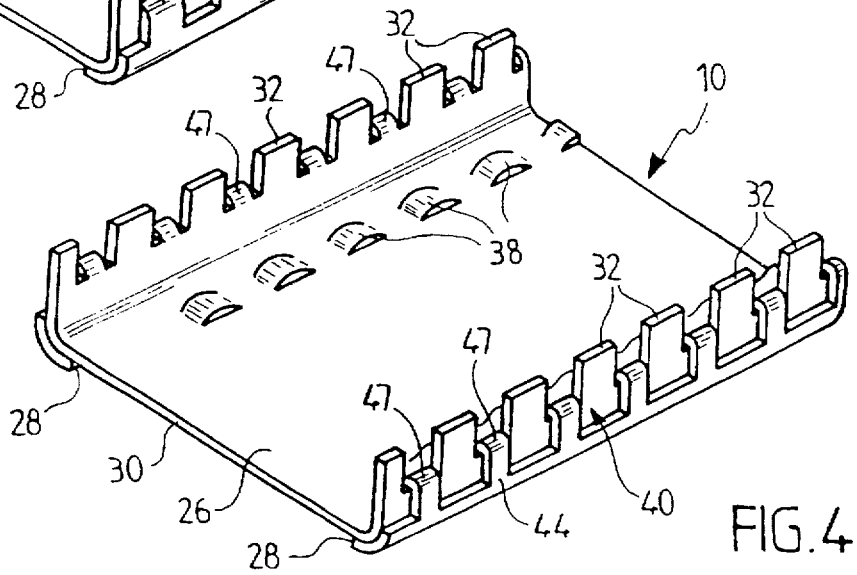
FIG. 4 is a view similar to that in FIG. 3, for another embodiment of the header plate.

In the modified embodiment shown in FIG. 4, to which reference is now made, the integral bridges 47 have a width which is less than the width defined between two consecutive retaining lugs 32. This is due to the fact that the lugs 32 are obtained, as shown in FIG. 5, by forming U-shaped slots 48 with simultaneous raising of the material.

The metal strip thus obtained (FIG. 3, FIG. 4 and FIG. 8) is now cut to the length required to form a header plate. The holes 24 are then formed in the base wall 26 as described above with reference to FIG. 1. Each of the holes 24 is surrounded by a collar portion 50 as shown in FIG. 9, which also shows one of the tubes 16 of the heat exchanger body.

The header plate 10, the tubes 16, and the fins 18 are now joined together by brazing in an appropriate oven, and this operation also secures together by brazing the two edge portions 40 and the respective reinforcing elements 44. It is then sufficient to position the header cover 12 so that the two portions of its claw element 34 become engaged in the two recesses 46 in FIG. 8. Each of these longitudinal portions of the claw element is then retained between the corresponding set of projections 38 and one of the edge portions 40.

Figure 9:
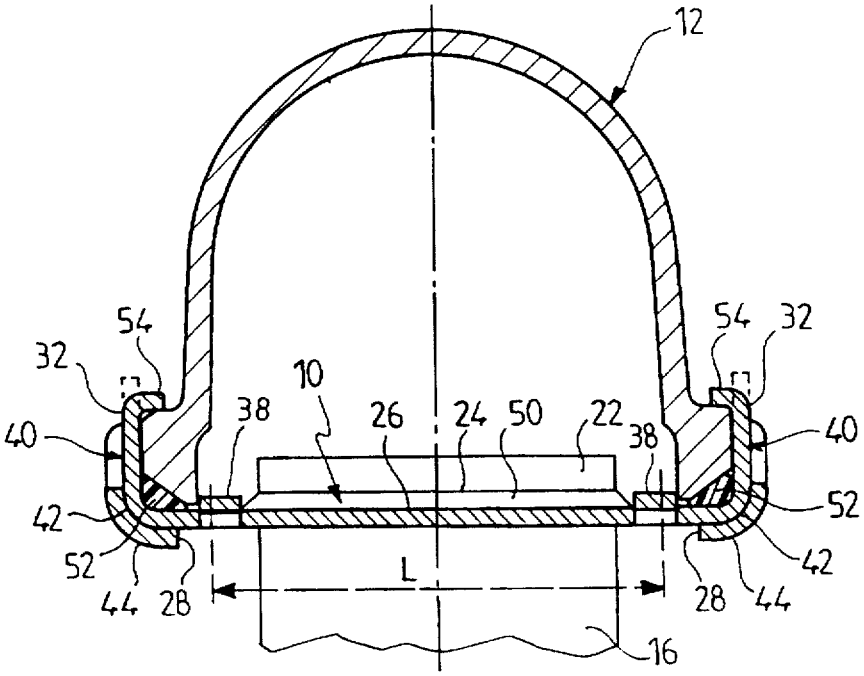
FIG. 9 is a view in transverse cross section of the header plate after it has been secured to a bundle of tubes and to a header cover.

During the fitting operation, a sealing gasket 52 is interposed in the manner shown in FIG. 9. This gasket extends over the whole perimeter of the header plate. As mentioned above, centring of the header plate is effected by the flanges 36 of the claw element 34.

The ends of the retaining lugs 32 are then bent back so as to constitute upset ends 54 in the form of claws.

In this way, a header plate is formed from a standard profiled blank, and all that needs to be done is to cut this blank to the length required according to the desired dimensions of the header plate. This facilitates standardisation in manufacture.

Due to the fact that the base wall 26 of the header plate is flat, it makes more space available for the tubes 16, and this in turn enables an increased number of tubes to be used, and also enables the dimension of these tubes in the region of their major axis to be increased. This dimension may reach a maximum width L as shown in FIG. 9, if the transverse width of the projections 38 is reduced.

In addition, assembly of the header plate to the tube bundle is facilitated, and it is possible to pass a guide comb for the tubes between the corrugated inserts 18 and the header plate 10. Moreover, it is possible to omit a preliminary seaming operation, due to the fact that the header cover 12 is able to be clipped on to the header plate 10 in the region of its longitudinal ends.

The invention is most particularly applicable to motor vehicle heat exchangers.

What is claimed is:

1. A header assembly comprising a header and a heat exchanger body, the header comprising a header cover and a header plate secured together, the heat exchanger body comprising a set of tubes secured to the header plate and open into the header, the header cover having a claw element, the header plate comprising a base wall which defines over at least part of a header plate periphery a recess for receiving said claw element, the header plate further having retaining lugs cooperable with said claw element, to secure the header cover and header plate together, wherein the base wall is substantially flat, having an inner face and an outer face, and includes sets of integral projections formed on its inner face, the base wall further including a bent-back edge portion along each of a plurality of longitudinal sides, with each said edge portion and a corresponding set of said projections defining therebetween said recess for receiving the claw element, the retaining lugs extending from said bent-back edge portions.

2. A header assembly according to claim 1, wherein said projections are spaced apart and aligned with each other.

3. A header assembly according to claim 1, wherein said projections consist of raised portions having a depth smaller than a thickness of the base wall.

4. A header assembly according to claim 1, wherein each said bent-back edge portion is extended by a reinforcing element formed by upsetting and bending it back under the corresponding bent-back edge portion on the outer surface of the base wall, the base wall having U-shaped slots formed therein to define the said retaining lugs in the form of teeth.

5. A header assembly according to claim 1, wherein the base wall is substantially rectangular and defines two said recesses, the said recesses being longitudinal and parallel with each other, the said projections being arranged in two rows, with each said recess being delimited by a corresponding said row of projections and by a longitudinal said bent-back edge portion having said retaining lugs.

6. A header assembly according to claim 5, having two transverse edges from which said projections are absent, the claw element of the header cover having a flange engaging externally with each said transverse edge of the header plate.

7. A header assembly according to claim 1, comprising metallic material with a braze alloy on its outer surface.

8. A heat exchanger assembly comprising a header and a heat exchanger body, the header comprising a header cover and a header plate secured together, the heat exchanger body comprising a set of tubes secured to the header plate and open into the header, the header cover having a claw element, the header plate comprising a base wall which defines over at least part of a header plate periphery a recess for receiving said claw element, the header plate further having retaining lugs cooperable with said claw element, to secure the header cover and header plate together, wherein the base wall is substantially flat, having an inner face and an outer face, and includes sets of integral projections formed on its inner face, the base wall further including a bent-back edge portion along each of a plurality of longitudinal sides, with each said edge portion and a corresponding set of said projections defining therebetween said recess for receiving the claw element, the retaining lugs extending from said bent-back edge portions.

* * * * *